US009715201B2

(12) United States Patent
Hase et al.

(10) Patent No.: US 9,715,201 B2
(45) Date of Patent: Jul. 25, 2017

(54) FIXING DEVICE AND IMAGE FORMING APPARATUS INCLUDING A ROTATION LOAD APPLICATOR

(71) Applicants: Takamasa Hase, Tokyo (JP); Takashi Fujita, Kanagawa (JP); Seiji Saitoh, Kanagawa (JP); Kenji Ishii, Kanagawa (JP); Akiyasu Amita, Kanagawa (JP); Kenichi Hasegawa, Kanagawa (JP); Takashi Seto, Kanagawa (JP); Tetsuo Tokuda, Tokyo (JP); Hiroshi Seo, Kanagawa (JP); Hironori Yamaoka, Kanagawa (JP)

(72) Inventors: Takamasa Hase, Tokyo (JP); Takashi Fujita, Kanagawa (JP); Seiji Saitoh, Kanagawa (JP); Kenji Ishii, Kanagawa (JP); Akiyasu Amita, Kanagawa (JP); Kenichi Hasegawa, Kanagawa (JP); Takashi Seto, Kanagawa (JP); Tetsuo Tokuda, Tokyo (JP); Hiroshi Seo, Kanagawa (JP); Hironori Yamaoka, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 15/182,034

(22) Filed: Jun. 14, 2016

(65) Prior Publication Data

US 2017/0003633 A1 Jan. 5, 2017

(30) Foreign Application Priority Data

Jun. 30, 2015 (JP) ..... 2015-131463

(51) Int. Cl.
*G03G 15/20* (2006.01)

(52) U.S. Cl.
CPC ..... *G03G 15/2053* (2013.01); *G03G 15/2064* (2013.01); *G03G 2215/0636* (2013.01);
(Continued)

(58) Field of Classification Search
CPC ..... G03G 15/2053; G03G 15/1615; G03G 15/2089; G03G 2215/20; G03G 2215/0636; G03G 2215/2019
See application file for complete search history.

(56) References Cited

U.S. PATENT DOCUMENTS 6,131,009 A 10/2000 Hasegawa
6,587,664 B1 * 7/2003 Baughman ..... G03G 15/2064 399/328

(Continued)

FOREIGN PATENT DOCUMENTS

JP 2011-209445 10/2011
JP 2014-081610 5/2014

*Primary Examiner* — Francis Gray
(74) *Attorney, Agent, or Firm* — Oblon, McClelland, Maier & Neustadt, L.L.P.

(57) ABSTRACT

A fixing device includes a fixing rotator rotatable in a predetermined direction of rotation and a pressure rotator to press against the fixing rotator to form a fixing nip therebetween, through which a recording medium bearing a toner image is conveyed. A rotation load applicator is coupled to one of the fixing rotator and the pressure rotator to apply a rotation load to the one of the fixing rotator and the pressure rotator. The rotation load is in a range of from 0.1 Nm to 0.6 Nm.

19 Claims, 5 Drawing Sheets

(52) U.S. Cl.
CPC . *G03G 2215/20* (2013.01); *G03G 2215/2032* (2013.01); *G03G 2215/2035* (2013.01)

(56) References Cited

U.S. PATENT DOCUMENTS

| | | | | |
|---|---|---|---|---|
| 2003/0081966 | A1* | 5/2003 | Wakamatsu | G03G 15/0126 399/228 |
| 2005/0025523 | A1* | 2/2005 | Iwasaki | G03G 15/757 399/167 |
| 2005/0025537 | A1 | 2/2005 | Echigo et al. | |
| 2006/0115292 | A1* | 6/2006 | Sampe | G03G 15/0225 399/100 |
| 2009/0052925 | A1* | 2/2009 | Fujimoto | G03G 15/206 399/67 |
| 2013/0121716 | A1* | 5/2013 | Okuno | G03G 15/2053 399/67 |
| 2014/0363185 | A1* | 12/2014 | Tamada | G03G 15/2064 399/68 |
| 2015/0072278 | A1* | 3/2015 | Mizoguchi | G03G 9/08724 430/105 |
| 2015/0139706 | A1* | 5/2015 | Fujiwara | G03G 15/2064 399/329 |
| 2015/0198920 | A1* | 7/2015 | Fukuhata | G03G 15/2064 399/329 |
| 2015/0212466 | A1* | 7/2015 | Fukunaga | G03G 15/2064 399/122 |

* cited by examiner

FIXING DEVICE AND IMAGE FORMING APPARATUS INCLUDING A ROTATION LOAD APPLICATOR

CROSS-REFERENCE TO RELATED APPLICATION

This patent application is based on and claims priority pursuant to 35 U.S.C. §119 to Japanese Patent Application No. 2015-131463, filed on Jun. 30, 2015, in the Japanese Patent Office, the entire disclosure of which is hereby incorporated by reference herein.

BACKGROUND

Technical Field

Exemplary aspects of the present disclosure relate to a fixing device and an image forming apparatus, and more particularly, to a fixing device for fixing a toner image on a recording medium and an image forming apparatus incorporating the fixing device.

Description of the Background

Related-art image forming apparatuses, such as copiers, facsimile machines, printers, or multifunction printers having two or more of copying, printing, scanning, facsimile, plotter, and other functions, typically form an image on a recording medium according to image data. Thus, for example, a charger uniformly charges a surface of a photoconductor; an optical writer emits a light beam onto the charged surface of the photoconductor to form an electrostatic latent image on the photoconductor according to the image data; a developing device supplies toner to the electrostatic latent image formed on the photoconductor to render the electrostatic latent image visible as a toner image; the toner image is directly transferred from the photoconductor onto a recording medium or is indirectly transferred from the photoconductor onto a recording medium via an intermediate transfer belt; finally, a fixing device applies heat and pressure to the recording medium bearing the toner image to fix the toner image on the recording medium, thus forming the image on the recording medium.

Such fixing device may include a fixing rotator, such as a fixing roller, a fixing belt, and a fixing film, heated by a heater and a pressure rotator, such as a pressure roller and a pressure belt, pressed against the fixing rotator to form a fixing nip therebetween through which a recording medium bearing a toner image is conveyed. As the recording medium bearing the toner image is conveyed through the fixing nip, the fixing rotator and the pressure rotator apply heat and pressure to the recording medium, melting and fixing the toner image on the recording medium.

SUMMARY

This specification describes below an improved fixing device. In one exemplary embodiment, the fixing device includes a fixing rotator rotatable in a predetermined direction of rotation and a pressure rotator to press against the fixing rotator to form a fixing nip therebetween, through which a recording medium bearing a toner image is conveyed. A rotation load applicator is coupled to one of the fixing rotator and the pressure rotator to apply a rotation load to the one of the fixing rotator and the pressure rotator. The rotation load is in a range of from 0.1 Nm to 0.6 Nm.

This specification further describes an improved image forming apparatus. In one exemplary embodiment, the image forming apparatus includes an image bearer to bear a toner image and a fixing rotator disposed downstream from the image bearer in a recording medium conveyance direction and rotatable in a predetermined direction of rotation. A pressure rotator presses against the fixing rotator to form a fixing nip therebetween, through which a recording medium bearing the toner image is conveyed. A rotation load applicator is coupled to one of the fixing rotator and the pressure rotator to apply a rotation load to the one of the fixing rotator and the pressure rotator. The rotation load is in a range of from 0.1 Nm to 0.6 Nm.

BRIEF DESCRIPTION OF THE DRAWINGS

A more complete appreciation of the disclosure and the many attendant advantages thereof will be readily obtained as the same becomes better understood by reference to the following detailed description when considered in connection with the accompanying drawings, wherein.

DETAILED DESCRIPTION OF THE DISCLOSURE

Figure 1:
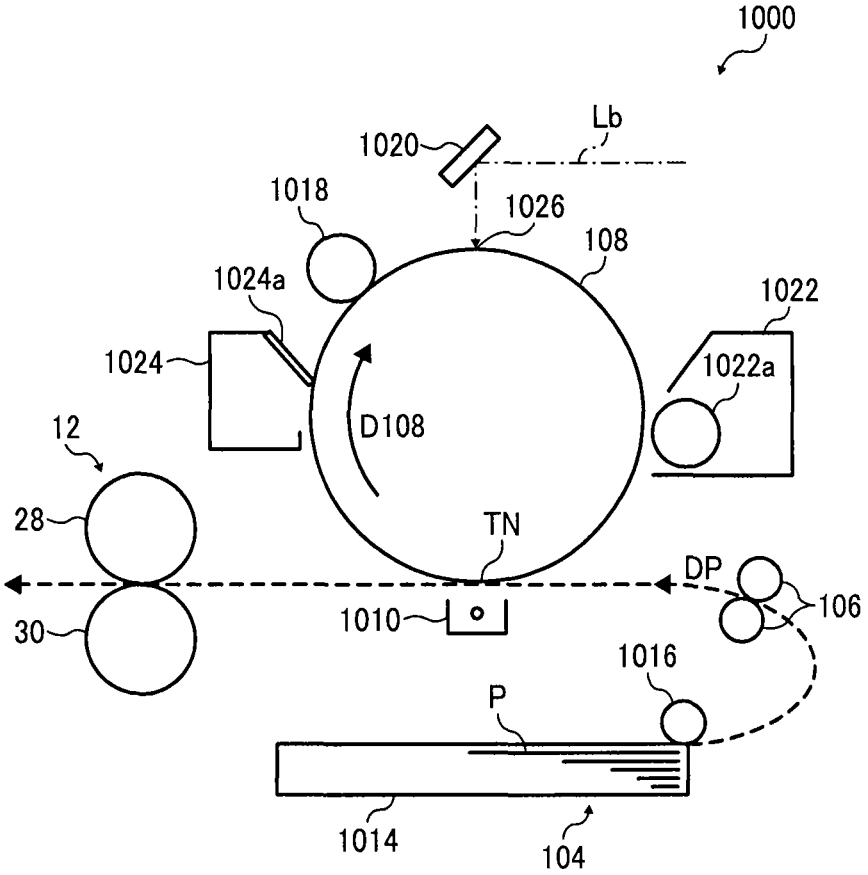
FIG. 1 is a schematic vertical cross-sectional view of an image forming apparatus employing a direct transfer method.

In describing exemplary embodiments illustrated in the drawings, specific terminology is employed for the sake of clarity. However, the disclosure of this specification is not intended to be limited to the specific terminology so selected and it is to be understood that each specific element includes all technical equivalents that operate in a similar manner and achieve a similar result.

Figure 2:
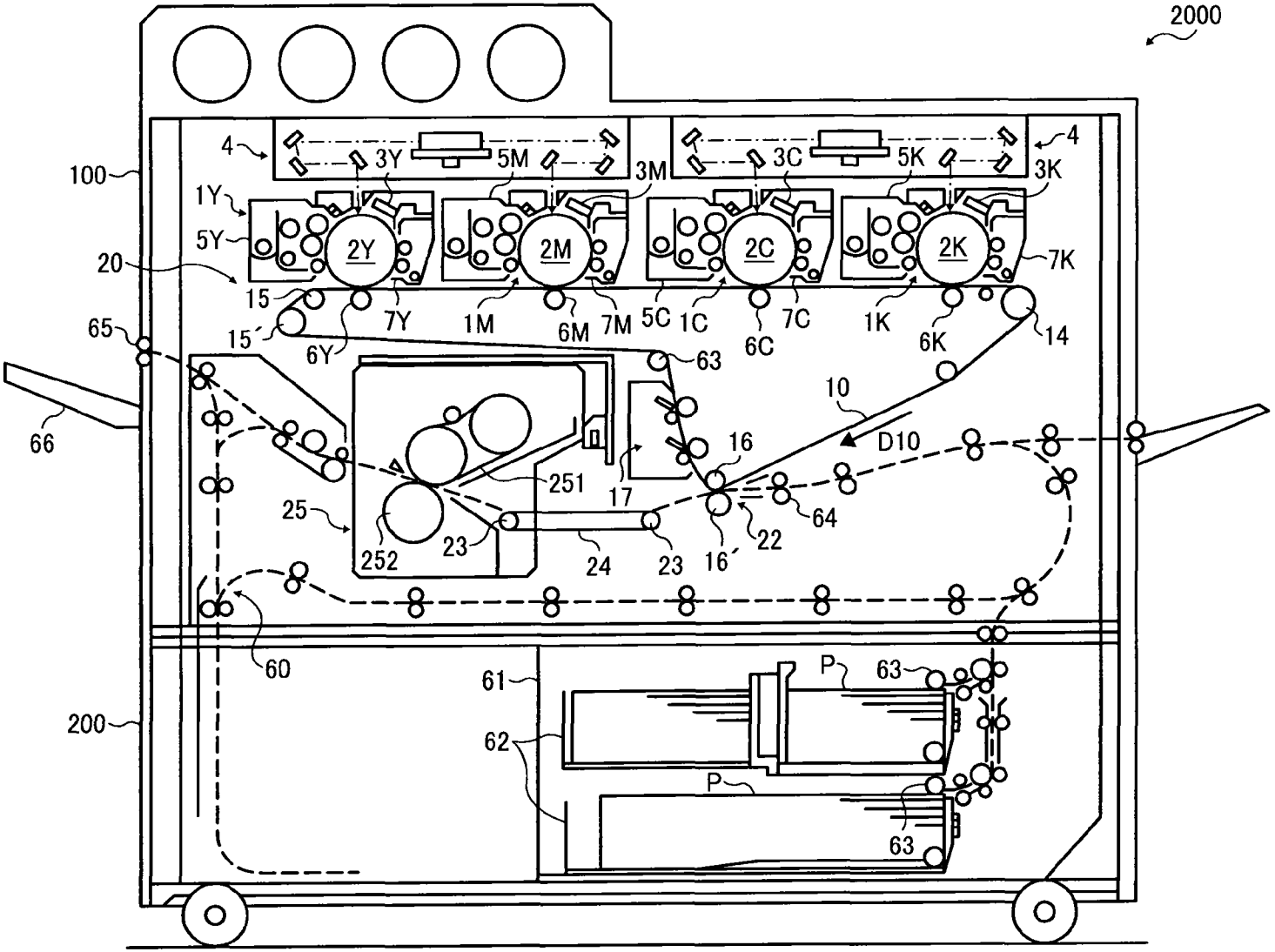
FIG. 2 is a schematic vertical cross-sectional view of an image forming apparatus employing an intermediate transfer method.

Referring now to the drawings, wherein like reference numerals designate identical or corresponding parts throughout the several views, in particular to FIGS. 1 and 2, image forming apparatuses 1000 and 2000 according to an exemplary embodiment of the present disclosure is explained.

It is to be noted that, in the drawings for explaining exemplary embodiments of this disclosure, identical reference numerals are assigned, as long as discrimination is possible, to components such as members and component parts having an identical function or shape, thus omitting description thereof once it is provided.

Each of the image forming apparatuses 1000 and 2000 may be a copier, a facsimile machine, a printer, a multifunction peripheral or a multifunction printer (MFP) having at least one of copying, printing, scanning, facsimile, and plotter functions, or the like. According to this exemplary embodiment, the image forming apparatus 1000 is a monochrome printer that forms a monochrome toner image on a recording medium by electrophotography. Alternatively, the image forming apparatus 1000 may be a color printer that forms a color toner image on a recording medium.

A description is provided of a construction of the image forming apparatuses 1000 and 2000.

Each of the image forming apparatuses 1000 and 2000 may be a printer, an MFP, or the like that forms an image on a recording medium by a wet process (e.g., electrophotography and inkjet) by drying and heating the recording medium placed inside each of the image forming apparatuses 1000 and 2000.

Referring to FIG. 1, a description is provided of a construction of the image forming apparatus 1000 to form a toner image on a recording medium by a direct transfer method.

FIG. 1 is a schematic vertical cross-sectional view of the image forming apparatus 1000. As illustrated in FIG. 1, the image forming apparatus 1000 includes a sheet feeder 104, a registration roller pair 106, a photoconductive drum 108 serving as an image bearer, a transfer device 1010, and a fixing device 12.

The sheet feeder 104 includes a paper tray 1014 that loads a plurality of sheets P (e.g., recording sheets) serving as recording media and a feed roller 1016 that picks up and separates an uppermost sheet P from other sheets P of the plurality of sheets P loaded on the paper tray 1014. Thus, the feed roller 1016 feeds the sheet P one by one to the registration roller pair 106. The registration roller pair 106 temporarily halts the sheet P sent from the feed roller 1016 to correct skew of the sheet P and conveys the sheet P to a transfer nip TN formed between the photoconductive drum 108 and the transfer device 1010 at a time in synchronism with rotation of the photoconductive drum 108, that is, at a time when a leading edge of a toner image formed on the photoconductive drum 108 corresponds to a predetermined position in a leading end of the sheet P in a sheet conveyance direction DP.

The photoconductive drum 108 is surrounded by a charging roller 1018 serving as a charger, a mirror 1020 constituting a part of an exposure device, a developing device 1022 incorporating a developing roller 1022*a*, the transfer device 1010, and a cleaner 1024 incorporating a cleaning blade 1024*a*, which are arranged in this order clockwise in FIG. 1 in a rotation direction D108 of the photoconductive drum 108. A light beam Lb reflected by the mirror 1020 irradiates and scans the photoconductive drum 8 at an exposure position 1026 thereon interposed between the charging roller 1018 and the developing device 1022 in the rotation direction D108 of the photoconductive drum 108.

A description is provided of an image forming operation to form a toner image on a sheet P that is performed by the image forming apparatus 1000 having the construction described above.

As the photoconductive drum 108 starts rotating, the charging roller 1018 uniformly charges an outer circumferential surface of the photoconductive drum 108. The exposure device emits a light beam Lb that scans the charged outer circumferential surface of the photoconductive drum 108 at the exposure position 1026 thereon according to image data sent from an external device such as a client computer, thus forming an electrostatic latent image on the photoconductive drum 108. The electrostatic latent image formed on the photoconductive drum 108 moves in accordance with rotation of the photoconductive drum 108 to a developing position thereon disposed opposite the developing device 1022 where the developing device 1022 supplies toner to the electrostatic latent image on the photoconductive drum 108, visualizing the electrostatic latent image as a toner image. As the toner image formed on the photoconductive drum 108 reaches the transfer nip TN, the toner image is transferred onto a sheet P conveyed from the paper tray 1014 and entering the transfer nip TN at a predetermined time by a transfer bias voltage applied by the transfer device 1010.

The sheet P bearing the toner image is conveyed to the fixing device 12 where a fixing roller 28 and a pressure roller 30 fix the toner image on the sheet P under heat and pressure. Thereafter, the sheet P bearing the fixed toner image is ejected onto an output tray that stacks the sheet P. As residual toner failed to be transferred onto the sheet P at the transfer nip TN and therefore remaining on the photoconductive drum 108 moves under the cleaner 1024 in accordance with rotation of the photoconductive drum 108, the cleaning blade 1024*a* scrapes the residual toner off the photoconductive drum 108, thus cleaning the photoconductive drum 108. Thereafter, a discharger removes residual potential on the photoconductive drum 108, rendering the photoconductive drum 108 to be ready for a next image forming operation.

Referring to FIG. 2, a description is provided of a construction and an image forming operation of the image forming apparatus 2000 to form a toner image on a recording medium by an indirect transfer method.

FIG. 2 is a schematic vertical cross-sectional view of the image forming apparatus 2000. As illustrated in FIG. 2, the image forming apparatus 2000 is a printer employing a tandem intermediate transfer system. The image forming apparatus 2000 includes a body 100 and a sheet table 200 mounting the body 100. The body 100 includes an image forming portion 20 employing the tandem intermediate transfer system (hereinafter referred to as a tandem image forming portion). The image forming portion 20 includes a plurality of image forming devices 1Y, 1M, 1C, and 1K aligned horizontally. Suffixes Y, M, C, and K represent yellow, magenta, cyan, and black, respectively. An intermediate transfer belt 10 serving as an intermediate transferor (e.g., an endless belt) is situated in a substantially center portion of the body 100. The intermediate transfer belt 10 is looped over a plurality of support rollers 14, 15, 15', and 16 and rotatable clockwise in FIG. 2 in a rotation direction D10. On the left of the support roller 16 is an intermediate transfer belt cleaner 17. The intermediate transfer belt cleaner 17 removes residual toner failed to be transferred onto a sheet P and therefore remaining on the intermediate transfer belt 10 therefrom.

Above an upper face of the intermediate transfer belt 10 stretched taut across the support rollers 14 and 15 are the four image forming devices 1Y, 1M, 1C, and 1K aligned horizontally in the rotation direction D10 of the intermediate transfer belt 10 to form yellow, magenta, cyan, and black toner images, respectively, thus constituting the tandem image forming portion 20. The image forming devices 1Y, 1M, 1C, and 1K of the tandem image forming portion 20 include photoconductive drums 2Y, 2M, 2C, and 2K serving as image bearers that bear yellow, magenta, cyan, and black toner images, respectively.

Above the tandem image forming portion 20 is two exposure devices 4. The left exposure device 4 is disposed opposite the two image forming devices 1Y and 1M. The right exposure device 4 is disposed opposite the two image forming devices 1C and 1K. For example, each of the exposure devices 4 employs an optical scanning method and includes two light sources (e.g., a semiconductor laser, a semiconductor laser array, or a multi-beam light source), a coupling optical system, a common optical deflector (e.g., a polygon mirror), and two scanning-image forming optical systems. The exposure devices 4 expose the photoconductive drums 2Y, 2M, 2C, and 2K according to yellow, magenta, cyan, and black image data, forming electrostatic latent images on the photoconductive drums 2Y, 2M, 2C, and 2K, respectively.

The photoconductive drums 2Y, 2M, 2C, and 2K are surrounded by chargers 3Y, 3M, 3C, and 3K, developing devices 5Y, 5M, 5C, and 5K, and cleaners 7Y, 7M, 7C, and 7K, respectively. Before the exposure devices 4 expose the photoconductive drums 2Y, 2M, 2C, and 2K, the chargers 3Y, 3M, 3C, and 3K uniformly charge the photoconductive drums 2Y, 2M, 2C, and 2K, respectively. The developing devices 5Y, 5M, 5C, and 5K develop the electrostatic latent images formed on the photoconductive drums 2Y, 2M, 2C, and 2K by the exposure devices 4 with yellow, magenta, cyan, and yellow toners into yellow, magenta, cyan, and black toner images, respectively. The cleaners 7Y, 7M, 7C, and 7K remove residual toner failed to be transferred onto a sheet P and therefore remaining on the photoconductive drums 2Y, 2M, 2C, and 2K therefrom, respectively. Primary transfer rollers 6Y, 6M, 6C, and 6K serving as primary transferors or primary transfer devices are disposed opposite the photoconductive drums 2Y, 2M, 2C, and 2K via the intermediate transfer belt 10 to form primary transfer nips between the photoconductive drums 2Y, 2M, 2C, and 2K and the intermediate transfer belt 10, respectively, where the yellow, magenta, cyan, and black toner images formed on the photoconductive drums 2Y, 2M, 2C, and 2K are primarily transferred onto the intermediate transfer belt 10 as a color toner image.

Among the plurality of support rollers 14, 15, 15', and 16 that supports the intermediate transfer belt 10, the support roller 14 is a driving roller that drives and rotates the intermediate transfer belt 10. The support roller 14 is coupled to a motor through a driving force transmitter (e.g., a gear, a pulley, and a belt). When forming a black toner image on the intermediate transfer belt 10, a mover moves the support rollers 15 and 15' to isolate the intermediate transfer belt 10 from the photoconductive drums 2Y, 2M, and 2C used to form the yellow, magenta, and cyan toner images, respectively.

A sheet feeder 61 includes two paper trays 62 each of which loads a plurality of sheets P serving as recording media. A feed roller 63 picks up and feeds an uppermost sheet P from the plurality of sheets P loaded on the paper tray 62 toward a registration roller pair 64. The registration roller pair 64 temporarily halts the sheet P and conveys the sheet P to a secondary transfer device 22 at a proper time. The secondary transfer device 22 is disposed opposite the tandem image forming portion 20 via the intermediate transfer belt 10. The secondary transfer device 22 includes a secondary transfer roller 16' pressed against the support roller 16 serving as a secondary transfer opposed roller via the intermediate transfer belt 10. The secondary transfer roller 16' generates a transfer electric field to secondarily transfer the color toner image formed on the intermediate transfer belt 10 onto the sheet P conveyed by the registration roller pair 64.

Downstream from the secondary transfer device 22 in a sheet conveyance direction is a fixing device 25 that fixes the color toner image transferred from the intermediate transfer belt 10 onto the sheet P thereon. The fixing device 25 includes an endless fixing belt 251 and a pressure roller 252 pressed against the fixing belt 251. The fixing belt 251 is looped over two support rollers. A heater (e.g., a heater, a lamp, or an induction heater employing an electromagnetic induction heating method) is disposed inside at least one of the two support rollers.

A conveyance belt 24 supported by two rollers 23 conveys the sheet P bearing the color toner image transferred from the intermediate transfer belt 10 by the secondary transfer device 22 to the fixing device 25. Instead of the conveyance belt 24, a stationary guide, a conveyance roller, or the like may be used.

Below the secondary transfer device 22 and the fixing device 25 is a sheet reverse device 60 disposed in parallelism with the tandem image forming portion 20. The sheet reverse device 60 reverses and conveys the sheet P for duplex printing to print another toner image on a back side of the sheet P. The sheet P bearing the fixed color toner image is ejected by an output roller 65 onto an output tray 66.

In the image forming apparatus 2000 employing an intermediate transfer method, toner that may stain a background of the sheet P is reduced while the toner image is primarily transferred onto the intermediate transfer belt 10 and secondarily transferred onto the sheet P compared to in the image forming apparatus 1000 employing the direct transfer method. Thus, the image forming apparatus 2000 is more advantageous than the image forming apparatus 1000 in view of reduction of toner adhered to the fixing belt 251.

A description is provided of a construction of the fixing device 12 incorporated in the image forming apparatus 1000 depicted in FIG. 1.

The fixing device 12 employs a heating roller method.

Figure 3:
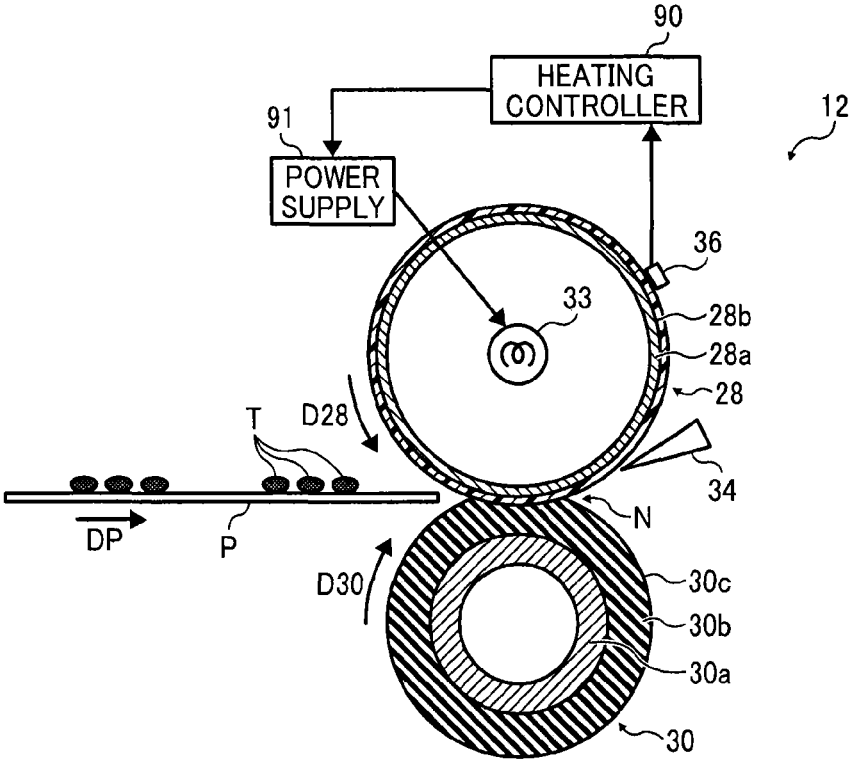
FIG. 3 is a schematic vertical cross-sectional view of a fixing device employing a heating roller fixing method that is incorporated in the image forming apparatus depicted in FIG. 1.

FIG. 3 is a schematic vertical cross-sectional view of the fixing device 12. As illustrated in FIG. 3, the fixing device 12 (e.g., a fuser or a fusing unit) includes the fixing roller 28 serving as a fixing rotator rotatable in a rotation direction D28 and the pressure roller 30 serving as a pressure rotator rotatable in a rotation direction D30. The fixing roller 28 includes a cored bar 28*a* and a release layer 28*b* coating the cored bar 28*a*. The cored bar 28*a* is made of metal such as stainless steel and aluminum. The release layer 28*b* constituting an outer surface layer contacts the pressure roller 30 to form a fixing nip N between the fixing roller 28 and the pressure roller 30. The release layer 28*b* facilitates separation of the sheet P and toner of a toner image T on the sheet P from the fixing roller 28. The release layer 28*b* is made of a heat resistant material having decreased surface energy, such as silicone resin and fluoro resin. For example, the release layer 28*b* is a heat resistant tube made of polymeric resin such as polytetrafluoroethylene (PTFE), tetrafluoroethylene-perfluoroalkylvinylether copolymer (PFA), and tetrafluoroethylene-hexafluoropropylene copolymer (FEP). The release layer 28*b* includes an additive made of carbon, silicon carbide (SiC) in an amount of 10 weight percent to enhance durability against abrasion. If the release layer 28*b* includes the additive in an amount of 3 weight percent or more, the release layer 28*b* achieves sufficient durability against abrasion. If the release layer 28*b* includes the additive in an amount of 20 weight percent or more, the additive is exposed on an outer circumferential surface of the fixing roller 28 with an increased rate, degrading separation of toner from the fixing roller 28.

Inside the cored bar 28*a* of the fixing roller 28 is a heater 33 (e.g., a halogen heater) that heats the fixing roller 28. According to this exemplary embodiment, the heater 33 is a halogen heater. Alternatively, the heater 33 may be an induction heater, a laminated heater, or other heaters.

The pressure roller 30 includes a cored bar 30*a*, an elastic layer 30*b* coating the cored bar 30*a*, and a release layer 30*c* coating the elastic layer 30*b*. The cored bar 30*a* is made of metal such as stainless steel and aluminum. The elastic layer 30*b* is made of a heat resistant, elastic material such as fluoro rubber and silicone rubber and has an appropriate thickness. Like the release layer 28*b* of the fixing roller 28, the release layer 30*c* constituting an outer surface layer is made of fluoro resin or the like. A pressurization assembly (e.g., a spring) presses the pressure roller 30 against the fixing roller 28. As the pressurization assembly elastically deforms the elastic layer 30*b* of the pressure roller 30, the pressure roller 30 and the fixing roller 28 form the fixing nip N therebetween where the fixing roller 28 and the pressure roller 30 apply heat and pressure to toner of the toner image T on the sheet P for a predetermine time.

A separation claw 34 contacts the fixing roller 28 to separate the sheet P from the fixing roller 28 as the sheet P bearing the fixed toner image T is ejected from the fixing nip N. A plurality of separation claws 34 may be aligned in an axial direction of the fixing roller 28. A surface of the separation claw 34 is made of polymeric resin such as PTFE, PFA, and FEP to prevent adhesion of toner to the separation claw 34.

In order to control the heater 33, a temperature sensor 36 (e.g., a thermistor) is disposed opposite the fixing roller 28 to detect the temperature of the fixing roller 28. A heating controller 90 controls a power supply 91 to adjust power supply to the heater 33 based on the temperature of the fixing roller 28 detected by the temperature sensor 36 so that the heater 33 heats the fixing roller 28 to a desired fixing temperature. According to this exemplary embodiment, the desired fixing temperature is set to 160 degrees centigrade based on a result of an examination of viscoelasticity and fixing property of toner.

A description is provided of a construction of the fixing device 25 employing a belt fixing method.

Figure 4:
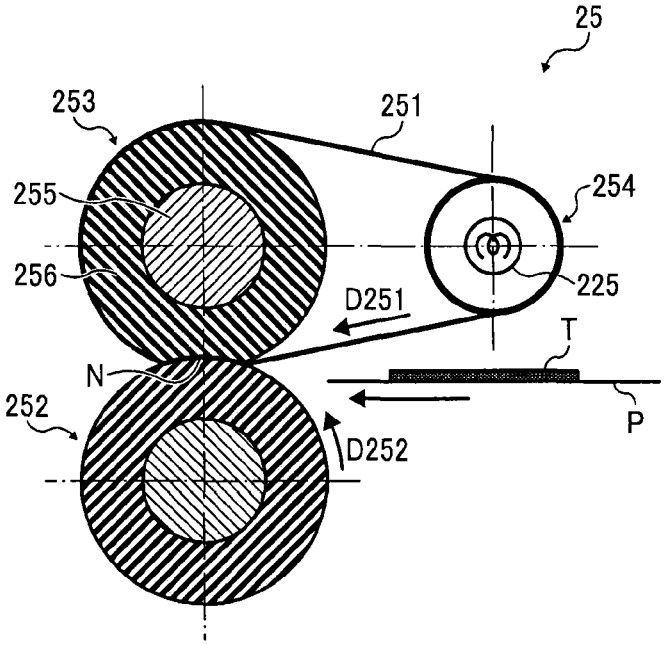
FIG. 4 is a schematic vertical cross-sectional view of a fixing device employing a belt fixing method that is incorporated in the image forming apparatus depicted in FIG. 2.

FIG. 4 is a schematic vertical cross-sectional view of the fixing device 25. As illustrated in FIG. 4, the fixing device 25 (e.g., a fuser or a fusing unit) includes the flexible, endless fixing belt 251, serving as a fixing rotator, formed into a loop and rotatable in a rotation direction D251, the pressure roller 252 serving as a pressure rotator rotatable in a rotation direction D252, a fixing roller 253, a heating roller 254, and a halogen heater 225. The fixing belt 251 is supported by the fixing roller 253 and the heating roller 254 that is disposed in parallel to the fixing roller 253. The fixing roller 253 is constructed of a cored bar 255 and an elastic layer 256 coating the cored bar 255. The cored bar 255 is made of metal such as stainless steel and aluminum or other material. The elastic layer 256 is made of rubber such as silicone rubber foam, silicone rubber, and fluoro rubber or other material.

The halogen heater 225 is disposed inside the heating roller 254 such that the halogen heater 225 is disposed opposite an inner circumferential surface of the heating roller 254. The fixing belt 251 is constructed of a base layer, an elastic layer coating the base layer, and a release layer coating the elastic layer. The fixing belt 251 has a total thickness of 1 mm or smaller. The base layer has a thickness in a range of from 20 micrometers to 50 micrometers. The base layer is made of resin such as polyimide or other material. The elastic layer has a thickness not smaller than 100 micrometers. If the thickness of the elastic layer is smaller than 100 micrometers, the elastic layer does not conform to slight surface asperities of a toner image T on a sheet P, degrading fixing at low temperatures. The elastic layer is made of rubber such as silicone rubber, silicone rubber foam, and fluoro rubber or other material.

The release layer has a thickness in a range of from 10 micrometers to 40 micrometers. The release layer is made of PFA, PTFE, polyimide, polyether imide, polyether sulfide (PES), or the like.

A description is provided of a construction of a fixing device 12S employing a free belt fixing method.

Figure 5:
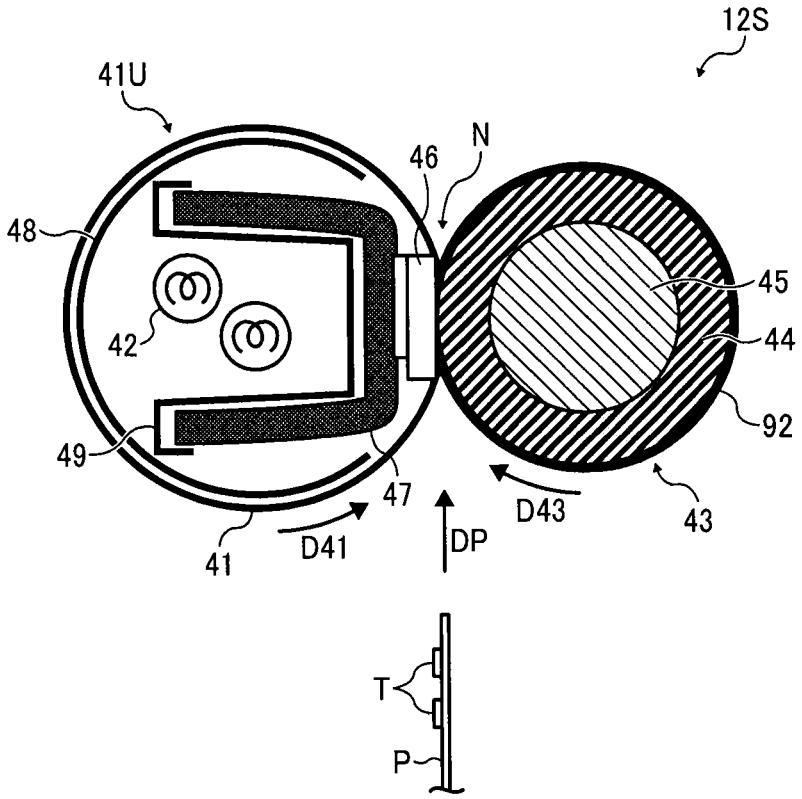
FIG. 5 is a schematic vertical cross-sectional view of a fixing device employing a free belt fixing method.

FIG. 5 is a schematic vertical cross-sectional view of the fixing device 12S.

As illustrated in FIG. 5, the fixing device 12S (e.g., a fuser or a fusing unit) employing the free belt fixing method includes a fixing belt 41 serving as a fixing rotator formed into a loop and rotatable in a rotation direction D41 and a pressure roller 43 serving as a pressure rotator rotatable in a rotation direction D43. A halogen heater 42 emits light that irradiates an inner circumferential surface of the fixing belt 41 directly, heating the fixing belt 41 with radiant heat. Inside the loop formed by the fixing belt 41 is a nip formation pad 46 disposed opposite the pressure roller 43 via the fixing belt 41 to form a fixing nip N between the fixing belt 41 and the pressure roller 43. As the fixing belt 41 rotates in the rotation direction D41, the inner circumferential surface of the fixing belt 41 slides over the nip formation pad 46 directly or indirectly via a slide sheet. The slide sheet is a low-friction sheet that reduces sliding friction between the fixing belt 41 and the nip formation pad 46. The slide sheet is made of a heat resistant material that attains a decreased friction coefficient with respect to the fixing belt 41 and a sufficient durability against abrasion. For example, the slide sheet is a rectangular fabric sheet made of porous fluoro resin. As illustrated in FIG. 5, the fixing nip N is planar. Alternatively, the fixing nip N may be contoured into a recess or other shapes. If the fixing nip N defines the recess, the recessed fixing nip N directs a leading edge of a sheet P toward the pressure roller 43 as the sheet P is ejected from the fixing nip N, facilitating separation of the sheet P from the fixing belt 41 and suppressing jamming of the sheet P.

The fixing belt 41 is an endless belt or film made of metal such as nickel and SUS stainless steel or resin such as polyimide. The fixing belt 41 is constructed of a base layer and a release layer. The release layer constituting an outer surface layer is made of PFA, PTFE, FEP, or the like to facilitate separation of toner of a toner image T on a sheet P from the fixing belt 41, thus preventing the toner of the toner image T from adhering to the fixing belt 41. An elastic layer may be sandwiched between the base layer and the release layer and made of silicone rubber or the like. If the fixing belt 41 does not incorporate the elastic layer, the fixing belt 41 has a decreased thermal capacity that improves fixing property of being heated quickly to a desired fixing temperature at which the toner image T is fixed on the sheet P. However, as the pressure roller 43 and the fixing belt 41 sandwich and press the toner image T on the sheet P passing through the fixing nip N, slight surface asperities of the fixing belt 41 may be transferred onto the toner image T on the sheet P, resulting in variation in gloss of the solid toner image that may appear as an orange peel image on the sheet P. To address this circumstance, the elastic layer made of silicone rubber has a thickness not smaller than 100 micrometers. As the elastic layer deforms, the elastic layer absorbs slight surface asperities of the fixing belt 41, preventing formation of the faulty orange peel image.

Inside the loop formed by the fixing belt 41 is a support 47 (e.g., a stay) that supports the nip formation pad 46. As the nip formation pad 46 receives pressure from the pressure roller 43, the support 47 supports the nip formation pad 46 to prevent bending of the nip formation pad 46 and produce an even nip length in the sheet conveyance direction DP throughout the entire width of the fixing belt 41 in an axial direction thereof. Since the support 47 supports the nip formation pad 46 against pressure from the pressure roller 43, the fixing belt 41 and the pressure roller 43 nip the sheet P at the fixing nip N with pressure great enough to melt and fix the toner image T on the sheet P. However, since the support 47 is produced by bending an iron plate or an SUS stainless steel plate that has a thickness of about 5 mm, the support 47 has an increased thermal capacity.

The support 47 is mounted on and held by holders 48 (e.g., flanges) at both lateral ends of the support 47 in a longitudinal direction thereof parallel to the axial direction of the fixing belt 41, respectively, thus being positioned inside the fixing device 12S. A reflector 49 interposed between the halogen heater 42 and the support 47 reflects radiant light or heat radiated from the halogen heater 42 to the reflector 49 toward the fixing belt 41, preventing the support 47 from being heated by the halogen heater 42 and thereby reducing waste of energy. Alternatively, instead of the reflector 49, an opposed face of the support 47 disposed opposite the halogen heater 42 may be treated with insulation or mirror finishing to reflect radiant light radiated from the halogen heater 42 to the support 47 toward the fixing belt 41. The fixing belt 41 and the components disposed inside the loop formed by the fixing belt 41, that is, the halogen heater 42, the nip formation pad 46, the support 47, and the reflector 49, may constitute a belt unit 41U separably coupled with the pressure roller 43.

The pressure roller 43 is constructed of a cored bar 45, an elastic rubber layer 44 coating the cored bar 45, and a surface release layer 92 coating the elastic rubber layer 44 and made of PFA or PTFE to facilitate separation of the sheet P from the pressure roller 43. As a driving force generated by a driver (e.g., a motor) situated inside the image forming apparatuses 1000 and 2000 depicted in FIGS. 1 and 2, respectively, is transmitted to the pressure roller 43 through a gear train, the pressure roller 43 rotates in the rotation direction D43 as illustrated in FIG. 5. A spring or the like presses the pressure roller 43 against the nip formation pad 46 via the fixing belt 41. As the spring presses and deforms the elastic rubber layer 44 of the pressure roller 43, the pressure roller 43 produces the fixing nip N having a predetermined length in the sheet conveyance direction DP. Alternatively, the pressure roller 43 may be a hollow roller that accommodates a heater such as a halogen heater. The elastic rubber layer 44 may be made of solid rubber. Alternatively, if no heater is situated inside the pressure roller 43, the elastic rubber layer 44 may be made of sponge rubber. The sponge rubber is more preferable than the solid rubber because the sponge rubber has an increased insulation that draws less heat from the fixing belt 41.

As the pressure roller 43 rotates in the rotation direction D43, the fixing belt 41 rotates in the rotation direction D41 in accordance with rotation of the pressure roller 43 by friction therebetween. According to this exemplary embodiment illustrated in FIG. 5, as the driver drives and rotates the pressure roller 43, a driving force of the driver is transmitted from the pressure roller 43 to the fixing belt 41 at the fixing nip N, thus rotating the fixing belt 41 by friction between the pressure roller 43 and the fixing belt 41. At the fixing nip N, the fixing belt 41 rotates as it is sandwiched between the pressure roller 43 and the nip formation pad 46; at a circumferential span of the fixing belt 41 other than the fixing nip N, the fixing belt 41 rotates as it is guided by the holder 48 (e.g., the flange) at each lateral end of the fixing belt 41 in the axial direction thereof. With the construction described above, the fixing device 12S attaining quick warm-up is manufactured at reduced costs.

In the fixing device 12S depicted in FIG. 5 employing the free belt fixing method, friction between the nip formation pad 46 and the fixing belt 41 sliding over the nip formation pad 46 imposes a rotation torque to the fixing belt 41, generating a slight difference between a linear velocity of the fixing belt 41 and a linear velocity of the pressure roller 43 and preventing adhesion of toner to the fixing belt 41.

A description is provided of adhesion of toner.

Although the following describes adhesion of toner with reference to the fixing device 12 depicted in FIG. 3 that incorporates the fixing roller 28, adhesion of toner is also applicable to the fixing devices 25 and 12S depicted in FIGS. 4 and 5, respectively. As illustrated in FIG. 3, toner of the toner image T on the sheet P receives heat and pressure at the fixing nip N formed between the fixing roller 28 and the pressure roller 30. The toner is melted by heat and attains a decreased viscoelasticity. Simultaneously, the toner is spread over the sheet P by pressure and entered into a fiber of the sheet P. As the sheet P is ejected from the fixing nip N, the separation claw 34 separates the sheet P from the fixing roller 28 and the pressure roller 30.

The toner is melted by heat and enters the fiber of the sheet P. Simultaneously, the toner is susceptible to adhesion to the fixing roller 28. If the toner is melted and an adhesion force that adheres the toner to the fixing roller 28 is greater than an adhesion force that adheres the toner to the sheet P, the melted toner may move from the sheet P to the fixing roller 28, causing offset. The offset toner may accumulate on the separation claw 34 and the temperature sensor 36 (e.g., the thermistor). As the fixing roller 28 rotates and halts repeatedly, the toner accumulated on the separation claw 34 and the temperature sensor 36 may fall down onto the fixing roller 28. The toner may move from the fixing roller 28 to the sheet P as re-adhesion, staining the toner image T on the sheet P as black spots.

Re-adhesion of the toner to the sheet P and adhesion of the toner to the fixing roller 28 vary depending on a physical property of the toner and a filler contained in the sheet P. For example, if the sheet P contains heavy calcium carbonate produced by a pulverization method as a filler, an adhesion substance produced with the toner and the heavy calcium carbonate contained in the sheet P may be fixed on the sheet P or may be adhered to the pressure roller 30, which may appear as a faulty toner image suffering from black spots. Degradation in the toner image T on the sheet P may occur frequently with toner having a degraded offset.

Toner that appears as background stains on the sheet P bearing the toner image T suffers from degradation in offset and adhesion. On the other hand, an adhesion portent toner adhered to the fixing roller 28 is transferred onto the sheet P together with an unfixed toner not fixed on the sheet P by a self-cleaning effect. The greater an image area rate of the toner image T on the sheet P, the greater the self-cleaning effect, suppressing adhesion of toner to the fixing roller 28. The adhesion portent toner defines toner in a size that is not great enough to render the toner to be visible. For example, the adhesion portent toner is about 1 mm or smaller.

In order to address those circumstances, a comparative fixing device may include a cleaning web that slidably contacts a fixing roller or a pressure roller to remove toner from the fixing roller and the pressure roller.

Alternatively, another comparative fixing device may include a load applicator that applies a predetermined load torque to a fixing roller that rotates in accordance with rotation of a pressure roller to generate a slight linear velocity differential between the fixing roller and the pressure roller so as to remove wax from a surface of a fixing belt looped over the fixing roller, thus preventing faulty variation in gloss of a toner image on a sheet.

However, the cleaning web may require a driver and a controller that drive the cleaning web. Additionally, the cleaning web may increase maintenance costs and occupy a space. If a motor is used as the load applicator, the load applicator may increase manufacturing costs and occupy a space. In order to prevent adhesion of toner to the fixing roller and the fixing belt and improve the quality of the toner image on the sheet, it is requested to determine the load torque appropriately.

A faulty toner image suffering from black spots caused by re-adhesion of toner to the fixing roller 28 generates at a frequency that varies depending on an image area rate, a monochrome print rate, and a print condition. The image area rate defines a rate of an area of the toner image T relative to an area of the sheet P. The monochrome print rate defines a rate at which the toner image T is printed in monochrome. The print condition defines a rate at which the sheet P contains the filler (e.g., the heavy calcium carbonate) that defines the quality of the sheet P. The monochrome print rate is an index indicating an influence that the physical property of black toner imposes on the sheet P. Thus, the image area rate, the print condition of toner with which the toner image T is formed, such as the physical property of toner, or the print condition of the sheet P onto which the toner image T is formed, such as the quality of the sheet P, changes the frequency at which the faulty toner image suffering from black spots is formed.

A description is provided of a construction of a rotation load applicator 93 incorporated in the fixing device 12 depicted in FIG. 3.

Figure 6:
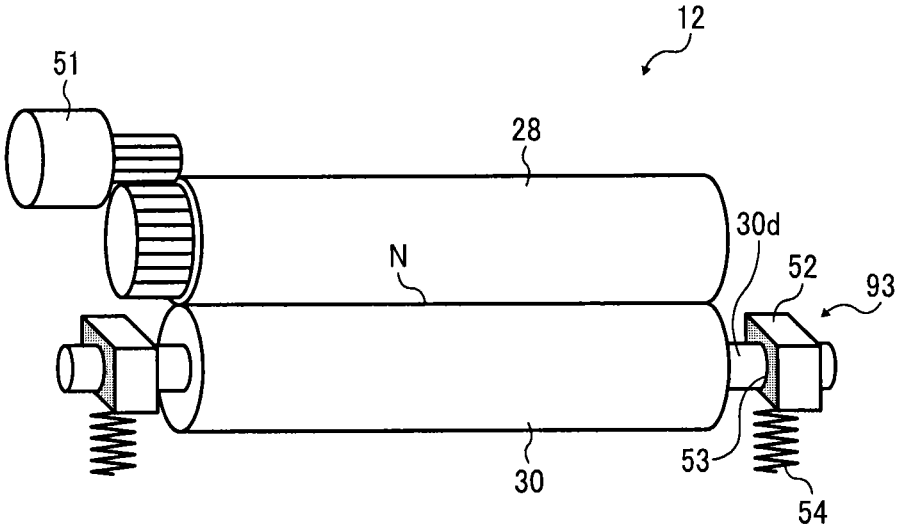
FIG. 6 is a perspective view of the fixing device depicted in FIG. 3 illustrating a rotation load applicator incorporated therein.

It is to be noted that the rotation load applicator 93 is also installable in the fixing devices 25 and 12S depicted in FIGS. 4 and 5, respectively. FIG. 6 is a perspective view of the fixing device 12 illustrating the rotation load applicator 93 that imposes a rotation load to the fixing roller 28. As illustrated in FIG. 6, a driver 51 situated outside the fixing device 12 and inside the image forming apparatus 1000 depicted in FIG. 1 is coupled to the fixing roller 28 to drive and rotate the fixing roller 28. As the fixing roller 28 receives a driving force from the driver 51, the fixing roller 28 rotates in the rotation direction D28 depicted in FIG. 3. According to this exemplary embodiment illustrated in FIG. 6, as the fixing roller 28 is transmitted with the driving force from the driver 51, the pressure roller 30 pressed against the fixing roller 28 rotates in accordance with rotation of the fixing roller 28. Generally, the pressure roller 30 rotates at a rotation speed identical to a rotation speed of the fixing roller 28 by friction between the pressure roller 30 and the fixing roller 28. A slide bearing 52 is disposed at each lateral end of a shaft 30*d* of the pressure roller 30 in an axial direction thereof. The slide bearing 52 imposes a load torque to the pressure roller 30 that rotates in accordance with rotation of the fixing roller 28. A spring 54 exerts a bias or a load to the slide bearing 52 to form the fixing nip N between the fixing roller 28 and the pressure roller 30 and generates friction between the slide bearing 52 and the shaft 30*d* of the pressure roller 30, thus applying a rotation load torque to the pressure roller 30. A slide aid 53 is disposed on a slide face of the slide bearing 52 over which the shaft 30*d* of the pressure roller 30 slides, enhancing durability against abrasion of the slide bearing 52 and the pressure roller 30. Thus, the rotation load applicator 93 imposes the rotation load torque to the pressure roller 30 stably over time. The rotation load torque is adjusted by increasing the spring constant of the spring 54 or changing the type of the slide aid 53.

For example, when the fixing roller 28 conveys a sheet P of an A4 size in landscape orientation at a linear velocity of 150 mm/sec, the rotation load applicator 93 imposes the rotation load torque in a range of from 0.1 Nm to 0.6 Nm, preferably in a range of from 0.2 Nm to 0.4 Nm. The rotation load torque is adjusted based on a configuration of the fixing roller 28 and the pressure roller 30 and the length of the fixing nip N in the sheet conveyance direction DP. If the rotation load torque increases excessively, adhesion of toner to the fixing roller 28 is reduced effectively. However, the fixing roller 28 and the pressure roller 30 do not rotate with a slight linear velocity differential of 1 percent or smaller, resulting in white spots on the toner image T on the sheet P and degradation in offset of the toner image T. To address this circumstance, the rotation load torque is adjusted experimentally.

As the sheet P is conveyed through the fixing nip N, friction generates between the fixing roller 28 and a surface of the sheet P. Accordingly, it is experimentally confirmed that the fixing roller 28 frictionally peels a slight adhesion substance (e.g., adhesion toner adhered to the fixing roller 28) off the fixing roller 28 and the slight adhesion substance does not develop into a size great enough to render the slight adhesion substance to be visible.

A description is provided of a construction of a fixing device 12T (e.g., a fuser or a fusing unit) incorporating a rotation load applicator 94 as a variation of the rotation load applicator 93 depicted in FIG. 6.

Figure 7:
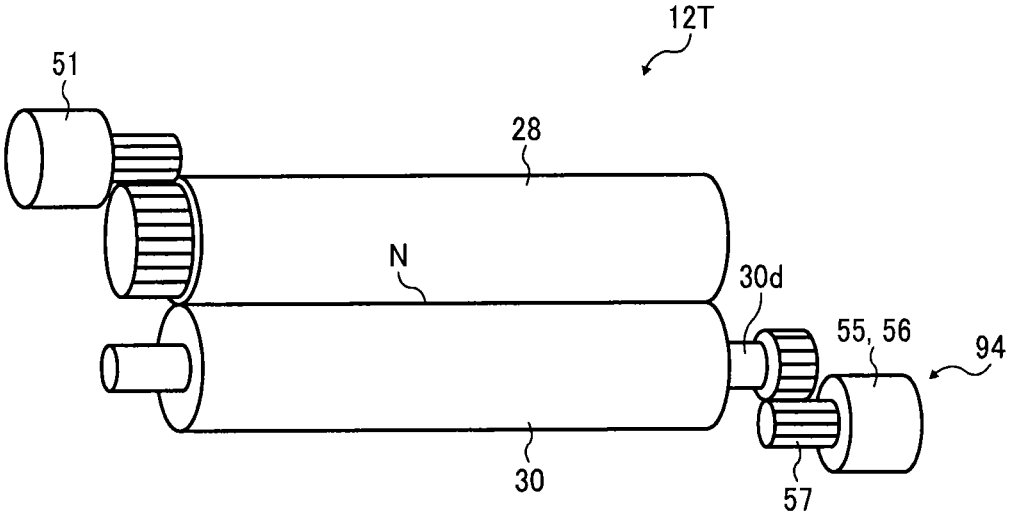
FIG. 7 is a perspective view of a fixing device incorporating a variation of the rotation load applicator depicted in FIG. 6.

FIG. 7 is a perspective view of the fixing device 12T. As illustrated in FIG. 7, instead of the slide bearing 52 depicted in FIG. 6, the rotation load applicator 94 includes an oil damper 55. As illustrated in FIG. 7, the oil damper 55 is coupled to the shaft 30*d* of the pressure roller 30 rotating in accordance with rotation of the fixing roller 28 through a gear 57 serving as a driving force transmitter. The oil damper 55 is situated inside the image forming apparatus 1000, downsizing the fixing device 12T. In addition to the type of the oil damper 55, a gear rate of the gear 57 is changed to adjust the rotation load torque imposed on the pressure roller 30. For example, rotary dampers TD88 and TD62 available from TOK BEARING CO., LTD. or the like are used as the oil damper 55.

Alternatively, a torque limiter 56 may be used as the rotation load applicator 94 similarly to the oil damper 55. For example, a magnet type torque limiter TLES1-816-40W available from TOK BEARING CO., LTD. is used as the torque limiter 56.

As illustrated in FIG. 6, the rotation load applicator 93 includes the slide bearing 52 that is installed in the fixing device 12 at reduced costs. However, the slide bearing 52 is disadvantageous in durability and susceptible to decrease in the rotation load torque over time. As illustrated in FIG. 7, the rotation load applicator 94 includes the oil damper 55 or the torque limiter 56 that is installed in the fixing device 12T at increased costs in an increased space compared to the slide bearing 52. However, the oil damper 55 and the torque limiter 56 are advantageous in durability and immune from decrease in the rotation load torque over time.

A description is provided of a verification experiment.

A copying test was performed with a fixing roller installed in a copier RICOH imagio NE0451 available from RICOH CO., LTD. and A4 size sheets in landscape orientation of plain paper copier (PPC) paper containing 25 weight percent of heavy calcium carbonate. Table 1 illustrates a result of the verification experiment. As the print condition, a toner image was a text printed at random at an image area rate of 3 percent. In order to examine toner adhesion, the toner image defined above was formed on 100,000 sheets with an interval of 20 seconds after each sheet to determine a level of dropping of adhesion toner onto the background of the sheet as three grades, that is, Grades A, B, and C. Grade A represents no adhesion toner. Grade B represents that adhesion toner appeared on 1 percent or smaller of 1,000 sheets. Grade C represents that an adhesion toner image appeared on 1 percent or greater of 1,000 sheets.

TABLE 1

| Embodiment | Transfer method | Fixing method | Rotation load applicator | Initial load torque [Nm] | Time-lapse load torque [Nm] | Toner adhesion grade | Image offset grade |
|---|---|---|---|---|---|---|---|
| Exemplary embodiment 1 | Direct | Heating roller | Slide bearing 1 | 0.2 | 0.1 | B | A |
| Exemplary embodiment 2 | Intermediate | Heating roller | Slide bearing 1 | 0.2 | 0.1 | A | A |
| Exemplary embodiment 3 | Direct | Belt | Slide bearing 1 | 0.2 | 0.1 | B | A |
| Exemplary embodiment 4 | Direct | Free belt | — | — | — | A | A |
| Exemplary embodiment 5 | Direct | Heating roller | Slide bearing 2 | 0.3 | 0.15 | B | A |
| Exemplary embodiment 6 | Direct | Heating roller | Oil damper 1 | 0.4 | 0.3 | A | A |
| Exemplary embodiment 7 | Direct | Heating roller | Oil damper 2 | 0.6 | 0.5 | A | B |
| Exemplary embodiment 8 | Direct | Heating roller | Torque limiter 1 | 0.3 | 0.2 | A | A |
| Exemplary embodiment 9 | Direct | Heating roller | Torque limiter 2 | 0.5 | 0.4 | A | A |
| Comparative embodiment 1 | Direct | Heating roller | Slide bearing 3 | 0.08 | 0.05 | C | A |
| Comparative embodiment 2 | Direct | Heating roller | Oil damper 3 | 0.05 | 0.045 | C | A |
| Comparative embodiment 3 | Direct | Heating roller | Oil damper 4 | 0.7 | 0.5 | A | C |
| Comparative embodiment 4 | Direct | Heating roller | Torque limiter 3 | 0.04 | 0.03 | C | A |
| Comparative embodiment 5 | Direct | Heating roller | Torque limiter 4 | 0.7 | 0.65 | A | C |

The verification experiment was performed on exemplary embodiments 1 to 9 and comparative embodiments 1 to 5. As illustrated in Table 1, an exemplary embodiment 1 employs the direct transfer method and the heating roller method. The slide bearing 52 was used as a rotation load applicator. The initial load torque was 0.2 Nm. The time-lapse load torque was 0.1 Nm. Since the rotation load torque decreased to 0.2 Nm or smaller over time, the toner adhesion grade was Grade B. However, the image offset grade marked Grade A.

Since an exemplary embodiment 2 employs the intermediate transfer method, stain toner that stained the background of the sheet was small and the toner adhesion grade marked Grade A. An exemplary embodiment 3 employing the belt fixing method, under the rotation load torque, achieved a result similar to the result of the exemplary embodiment 1.

An exemplary embodiment 4 employing the free belt fixing method, under the rotation load torque imposed on a fixing belt, achieved Grade A in the toner adhesion grade. In an exemplary embodiment 5, the initial load torque was 0.3 Nm and the time-lapse load torque was 0.15 Nm. Since the rotation load torque decreased to 0.2 Nm or smaller over time, the toner adhesion grade marked Grade B. However, the image offset grade marked Grade A.

Exemplary embodiments 6 and 7 used the oil damper 55 as a rotation load applicator. Exemplary embodiments 8 and 9 used the torque limiter 56 as a rotation load applicator. In an exemplary embodiment 7, since the rotation load torque was relatively high, the image offset grade marked Grade B. However, the exemplary embodiment 7 marked Grade A in the toner adhesion grade and the exemplary embodiments 6, 8, and 9 marked Grade A both in the toner adhesion grade and the image offset grade.

In comparative embodiments 1, 2, and 4, the rotation load torque was 0.1 Nm or smaller and the toner adhesion grade marked Grade C. In comparative embodiments 3 and 5, the rotation load torque was 0.6 Nm or greater and the image offset grade marked Grade C.

Accordingly, the rotation load torque imposed on the rotation load applicator that applies the rotation load to a fixing rotator (e.g., the fixing roller 28 and the fixing belts 251 and 41) and a pressure rotator (e.g., the pressure rollers 30, 252, and 43) is controlled to be in a range of from 0.1 Nm to 0.6 Nm, preferably in a range of from 0.2 Nm to 0.4 Nm, thus suppressing formation a faulty toner image due to toner adhesion.

A description is provided of advantages of the fixing devices 12, 25, 12S, and 12T.

As illustrated in FIGS. 3 to 7, a fixing device (e.g., the fixing devices 12, 25, 12S, and 12T) includes a fixing rotator (e.g., the fixing roller 28 and the fixing belts 251 and 41) and a pressure rotator (e.g., the pressure rollers 30, 252, and 43) contacting the fixing rotator to form the fixing nip N therebetween, through which a recording medium (e.g., a sheet P) bearing a toner image (e.g., a toner image T) is conveyed. As the recording medium is conveyed through the fixing nip N, the fixing rotator and the pressure rotator fix the toner image on the recording medium. A rotation load applicator (e.g., the rotation load applicators 93 and 94)

imposes a rotation load to one of the fixing rotator and the pressure rotator. The rotation load is in a range of from 0.1 Nm to 0.6 Nm.

Accordingly, a rotation load torque imposed on the rotation load applicator that applies the rotation load to the fixing rotator or the pressure rotator is adjusted to suppress formation of a faulty toner image due to adhesion of toner to the fixing rotator.

According to the exemplary embodiments described above, the fixing roller 28 and the fixing belts 251 and 41 serve as a fixing rotator. Alternatively, a fixing film, a fixing sleeve, or the like may be used as a fixing rotator. Further, the pressure rollers 30, 252, and 43 serve as a pressure rotator. Alternatively, a pressure belt or the like may be used as a pressure rotator.

The present disclosure has been described above with reference to specific exemplary embodiments. Note that the present disclosure is not limited to the details of the embodiments described above, but various modifications and enhancements are possible without departing from the spirit and scope of the disclosure. It is therefore to be understood that the present disclosure may be practiced otherwise than as specifically described herein. For example, elements and/or features of different illustrative exemplary embodiments may be combined with each other and/or substituted for each other within the scope of the present disclosure.

What is claimed is:

1. A fixing device comprising:

a fixing rotator rotatable in a predetermined direction of rotation;

a pressure rotator to press against the fixing rotator to form a fixing nip therebetween, through which a recording medium bearing a toner image is conveyed; and a rotation load applicator, coupled to one of the fixing rotator and the pressure rotator, to apply a rotation load to the one of the fixing rotator and the pressure rotator, the rotation load being in a range of from 0.1 Nm to 0.6 Nm, wherein the rotation load applicator includes a slide bearing coupled to the pressure rotator, and wherein the pressure rotator includes a shaft to slide over the slide bearing to apply the rotation load to the pressure rotator.

2. The fixing device according to claim 1, wherein the rotation load is in a range of from 0.2 Nm to 0.4 Nm.

3. The fixing device according to claim 1, wherein the rotation load applicator further includes a slide aid having durability against abrasion and disposed on the slide bearing, the slide aid over which the shaft of the pressure rotator slides.

4. The fixing device according to claim 1, wherein the rotation load applicator further includes a spring to exert a bias to the slide bearing.

5. The fixing device according to claim 1, further comprising:

a heater disposed inside the fixing rotator to heat the fixing rotator, wherein the fixing rotator includes a fixing roller including:

a hollow cored bar; and a release layer coating the cored bar, and wherein the pressure rotator includes a pressure roller to press against the fixing roller, the pressure roller being rotatable in accordance with rotation of the fixing roller and including an elastic layer.

6. The fixing device according to claim 1, further comprising:

a heating roller;

a heater to heat the heating roller; and a fixing roller disposed parallel to the heating roller, wherein the fixing rotator includes an endless fixing belt looped over the heating roller and the fixing roller, and wherein the pressure rotator is pressed against the fixing roller via the fixing belt.

7. The fixing device according to claim 1, further comprising:

a heater disposed inside the fixing rotator to heat the fixing rotator; and a nip formation pad disposed inside the fixing rotator, wherein the fixing rotator includes an endless fixing belt via which the pressure rotator is pressed against the nip formation pad.

8. An image forming apparatus comprising:

an image bearer to bear a toner image;

a fixing rotator disposed downstream from the image bearer in a recording medium conveyance direction and rotatable in a predetermined direction of rotation;

a pressure rotator to press against the fixing rotator to form a fixing nip therebetween, through which a recording medium bearing the toner image is conveyed; and a rotation load applicator, coupled to one of the fixing rotator and the pressure rotator, to apply a rotation load to the one of the fixing rotator and the pressure rotator, the rotation load being in a range of from 0.1 Nm to 0.6 Nm, wherein the rotation load applicator includes a slide bearing coupled to the pressure rotator, and wherein the pressure rotator includes a shaft to slide over the slide bearing to apply the rotation load to the pressure rotator.

9. The image forming apparatus according to claim 8, wherein the pressure rotator includes the shaft coupled to the rotation load applicator.

10. The image forming apparatus according to claim 9, further comprising a driving force transmitter interposed between the shaft of the pressure rotator and the rotation load applicator to transmit a driving force from the shaft of the pressure rotator to the rotation load applicator.

11. The image forming apparatus according to claim 10, wherein the driving force transmitter includes a gear.

12. The image forming apparatus according to claim 10, wherein the fixing rotator and the pressure rotator constitute a fixing device outside which the rotation load applicator is disposed.

13. The image forming apparatus according to claim 8, further comprising a transfer device to transfer the toner image formed on the image bearer onto the recording medium directly.

14. The image forming apparatus according to claim 8, further comprising:

an intermediate transfer belt;

a primary transfer device to primarily transfer the toner image formed on the image bearer onto the intermediate transfer belt; and a secondary transfer device to secondarily transfer the toner image formed on the intermediate transfer belt onto the recording medium.

15. The image forming apparatus according to claim 8, further comprising a driver coupled to the fixing rotator to drive and rotate the fixing rotator.

16. The fixing device according to claim 8, further comprising:

a heater disposed inside the fixing rotator to heat the fixing rotator; and a nip formation pad disposed inside the fixing rotator, wherein the fixing rotator includes an endless fixing belt via which the pressure rotator is pressed against the nip formation pad.

17. A fixing device comprising:

a fixing rotator rotatable in a predetermined direction of rotation;

a pressure rotator to press against the fixing rotator to form a fixing nip therebetween, through which a recording medium bearing a toner image is conveyed;

a rotation load applicator, coupled to one of the fixing rotator and the pressure rotator, to apply a rotation load to the one of the fixing rotator and the pressure rotator, the rotation load being in a range of from 0.1 Nm to 0.6 Nm; and a heater disposed inside the fixing rotator to heat the fixing rotator, wherein the fixing rotator includes a fixing roller including:

a hollow cored bar; and a release layer coating the cored bar, and wherein the pressure rotator includes a pressure roller to press against the fixing roller, the pressure roller being rotatable in accordance with rotation of the fixing roller and including an elastic layer.

18. The fixing device according to claim 17, wherein the rotation load applicator includes an oil damper.

19. The fixing device according to claim 17, wherein the rotation load applicator includes a torque limiter.

* * * * *